United States Patent [19]

Kinbara et al.

[11] Patent Number: 4,828,455

[45] Date of Patent: May 9, 1989

[54] TEMPERATURE RESPONSIVE BLADE SHROUD-DISK FOR THERMOSTATIC WATER PUMP

[75] Inventors: Minoru Kinbara, Toyota; Hiroaki Toyoda, Anjo, both of Japan

[73] Assignee: Aisin Seiki Kabushiki Kaisha, Kariya, Japan

[21] Appl. No.: 559,253

[22] Filed: Dec. 8, 1983

[30] Foreign Application Priority Data

Dec. 21, 1982 [JP] Japan ..... 57-194456[U]
Jan. 28, 1983 [JP] Japan ..... 58-11589[U]

[51] Int. Cl.[4] ..... F01P 7/16; F01D 7/00

[52] U.S. Cl. ..... 415/131; 415/48; 415/157; 123/41.44

[58] Field of Search ..... 415/48, 157, 158, 131, 415/132, 127; 416/39; 123/41.44

[56] References Cited

U.S. PATENT DOCUMENTS

| | | | |
|---|---|---|---|
| 17,246 | 5/1857 | Wright | 415/157 |
| 2,047,028 | 7/1936 | Metcalfe | 416/39 X |
| 2,075,498 | 3/1937 | Bondurant | 415/48 X |
| 2,114,567 | 4/1938 | Mercur | 415/48 X |
| 2,927,536 | 3/1960 | Rhoades | 415/157 |
| 2,957,424 | 10/1960 | Brundage | 415/48 |
| 4,417,849 | 11/1983 | Morris | 415/131 |

FOREIGN PATENT DOCUMENTS

| | | | |
|---|---|---|---|
| 257609 | 5/1963 | Australia | 416/39 |
| 526821 | 3/1954 | Belgium | 415/157 |
| 551218 | 2/1943 | United Kingdom | 415/131 |
| 2049832A | 12/1980 | United Kingdom | 415/131 |

*Primary Examiner*—Robert E. Garrett
*Assistant Examiner*—George Kapsalas
*Attorney, Agent, or Firm*—Oblon, Fisher, Spivak, McClelland & Maier

[57] ABSTRACT

A variable-capacity water pump includes a pump impelled fixed to a rotatable shaft for forcibly feeding cooling water from a cooling water passage, a mechanical seal disposed behind the pump impeller, a temperature sensor such as a thermostat mounted on the rotatable shaft and disposed in the cooling water passage for detecting the temperature of the cooling water, a thrust shaft disposed coaxially with the rotatable shaft and axially movable by the temperature sensor, and a disk secured to the thrust shaft for axial movement therewith, the disk being axially movable by the temperature sensor for varying a range of operation of the pump impeller. In response to a variation in the temperature of the cooling water, the temperature sensor axially moves the thrust shaft and hence the disk to vary the range of operation of the impeller, thereby changing the quantity of the cooling water flowing through the water pump. The water pump of the present invention can supply a quantity of cooling water necessary and sufficient to cope with the detected temperature of the cooling water without any unwanted power loss and with an increased degree of efficiency.

4 Claims, 4 Drawing Sheets

TEMPERATURE RESPONSIVE BLADE SHROUD-DISK FOR THERMOSTATIC WATER PUMP

BACKGROUND OF THE INVENTION

The present invention relates to a water pump, and more particularly to a variable-capacity water pump having an impeller construction capable of varying the capacity of the water pump.

Systems for cooling automotive engines have heretofore incorporated a water pump, as shown in FIG. 1 of the accompanying drawings, which is driven by the engine for forcibly circulating cooling water to cool the cylinder block and head. The water pump, generally designated at 10, has a rotatable shaft 11 drivable by the automotive engine and a pump impeller 12 fixed to an end of the rotatable shaft 11 which extends into a cooling water inlet tube 16. The pump impeller 12 has a boss 12*a* secured to the rotatable shaft 11, a flange 12*b* extending radially outwardly from the boss 12*a*, and impeller vanes 12*c* integrally projecting axially from the flange 12*b*. The water pump 10 also includes a mechanical seal 14 disposed behind the pump impeller 12 and normally urged by a spring 13 for preventing cooling water from leaking into a driving unit 15 on the rotatable shaft 11.

It is preferable that the quantity of cooling water flowing in such an engine cooling system be small during the warming-up of the engine or in the normal running condition. With the foregoing prior water pump, the pump impeller operates fully in response to rotation of the shaft 11, and will have already reached its full operation capacity when the engine is to be cooled. Accordingly, the water pump causes an increased power loss, and suffers from a poor cooling efficiency.

There has been proposed an engine cooling device, as disclosed in Japanese Laid-Open Patent Publication No. 51-98447, for reducing the quantity of cooling water flowing in the warming-up of the engine and normal running condition. The discosed engine cooling device has a control valve disposed in a cooling water passage for varying the quantity of cooling water to be supplied to a water pump dependent on the temperature of the cooling water. Since the cooling water flows into the control valve under a prescribed pressure, an arrangement is required to allow the control valve to operate reliably without being adversely affected by the water pressure acting on the control valve. In addition, the overall construction is complex because an attachment is needed for mounting the control valve and a space should be reserved in the cooling water passage for placing the control valve therein.

SUMMARY OF THE INVENTION

It is an object of the present invention to provide a water pump having a pump impeller with its water displacing capacity dependent on the temperature of engine cooling water.

According to the present invention, a variablecapacity water pump includes a temperature sensor such as a thermostat disposed in a cooling water passage for axially moving a thrust shaft disposed coaxially with a rotatable shaft drivable by an engine. A disk is fixed to the thrust shaft for axial movement therewith and has recesses through which the vanes of a pump impeller mounted on the rotatable shaft can move relatively in response to axial movement of the disk, thereby varying the range of operation of the impeller. The disk also has a shroud extending fully circumferentially thereof in radially surrounding relation to a radially outward edge of a flange of the pump impeller. In response to a variation in the temperature of the cooling water, the temperature sensor axially moves the thrust shaft and hence the disk to vary the range of operation of the impeller, thereby changing the quantity of the cooling water flowing through the water pump. The water pump of the present invention can supply a quantity of cooling water necessary and sufficent to cope with the detected temperature of the cooling water without any unwanted power loss and with an increased degree of efficiency.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
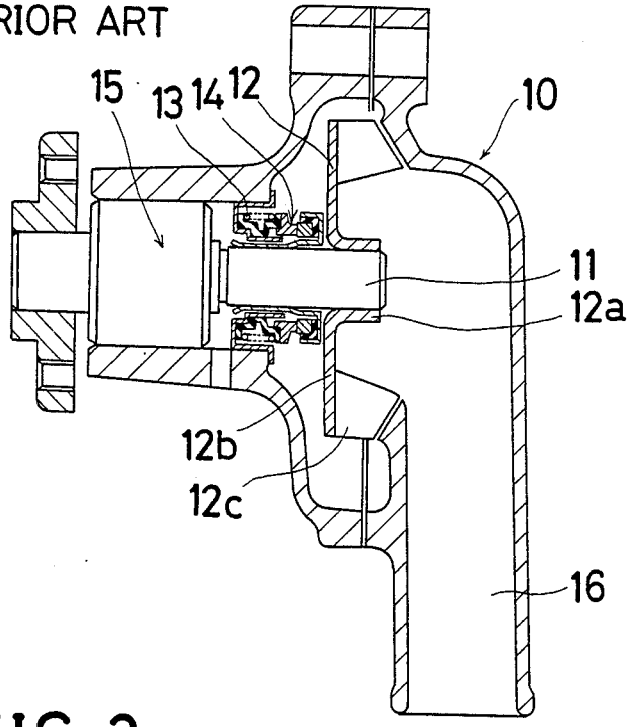
FIG. 1 PRIOR ART
FIG. 1 is a cross-sectional view of a conventional water pump.
Figure 2:
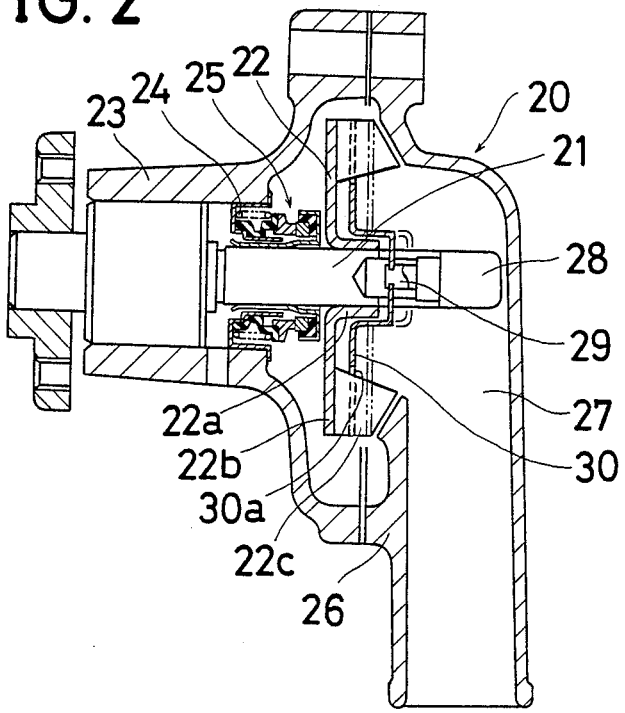
FIG. 2 is a cross-sectional view of a water pump according to a first embodiment of the present invention.

As shown in FIG. 2, a water pump 20 according to a first embodiment of the present invention comprises a rotatable shaft 21 rotatable by a driving output force from an engine. A pump impeller 22 is fixed to an end of the rotatable shaft 21 for rotation therewith. The pump impeller 22 comprises a boss 22*a* secured to the rotatable shaft 21, a flange 22*b* extending radially outwardly from the boss 22*a*, and impeller vanes 22*c* integrally projecting axially from the flange 22*b*. A mechanical seal 25 is mounted in a casing 23 disposed behind the pump impeller 22 and normally urged by a spring 24.

A pump body 26 is coupled to the casing 23 and has therein a cooling water passage 27. A thermostat 28 of the wax type is mounted on the rotatable shaft 21 and disposed in the cooling water passage 27. A thrust shaft 29 is disposed in coaxial relation to the rotatable shaft 21 and is axially movable by the thermostat 28. A disk 30 is fixed to the thrust shaft 29 for axial movement therewith. The disk 30 is positioned in front of the pump impeller 22 and has recesses 30*a* through which the vanes 22*c* of the pump impeller 22 extend. When the disk 30 is axially moved by the thermostat 28, the vanes 22*c* move relatively through the recesses 30*a*, Thus, the range in which the pump impeller 22 is operable can be varied in reponse to axial movement of the disk 30.

When the temperature of engine cooling water flowing through the cooling water passage 27 is relatively high, the thermostat 28 senses the temperature and moves the thrust shaft 29 to the left as shown. The disk 30 is also moved leftward with the thrust shaft 29 from the solid-line position, whereupon the range of operation of the pump impeller 22 is widened to increase the quantity of cooling water flowing through the water pump 20.

When the temperature of the engine cooling water is relatively low, the thrust shaft 29 is moved to the right by the thermostat 28. At this time, the disk 30 is also moved with the thrust shaft rightward to the two-dot-and-dash-line position, in which the disk 30 is maintained. The range of operation of the pump impeller 22 is now reduced, and so is the quantity of the cooling water discharged by the water pump 22.

With the foregoing arrangement, the thermostat 28 moves the thrust shaft 29 and hence the disk 30 axially in response to a sensed variation in the temperature of the engine cooling water. Therefore, the range of the impeller 22*c* of the pump impeller 22 can be varied dependent on the temperature of the engine cooling water, so that the quantity of the cooling water passing through the water pump 20 can be controlled in a predetermined range. An engine cooling system with the water pump of the invention incorporated therein can reduce any power loss while the engine is being cooled, and improves fuel economy.

Figure 3:
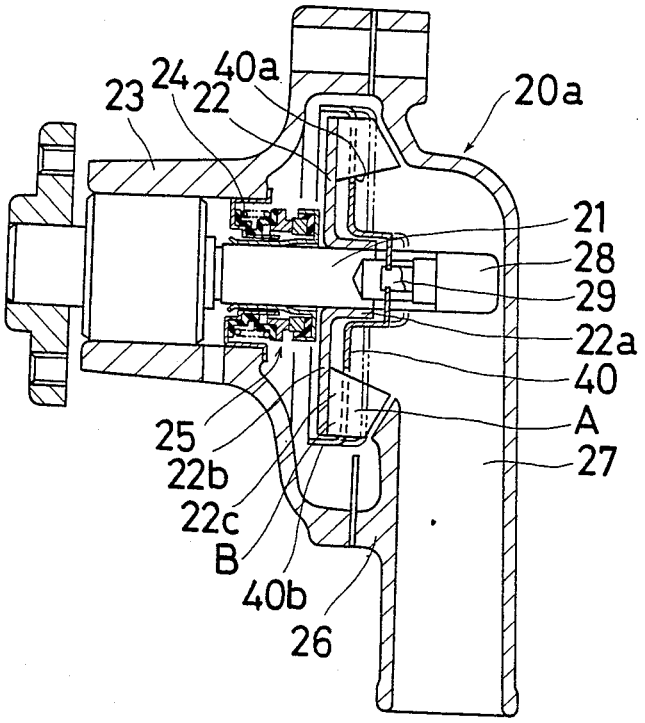
FIG. 3 is a cross-sectional view of a water pump according to a second embodiment of the present invention.
Figure 4:
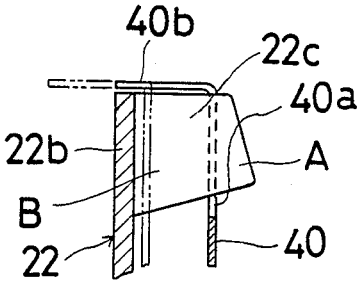
FIG. 4 is an enlarged fragmentary cross-sectional view of a portion of the water pump shown in FIG. 3.

FIGS. 3 and 4 illustrate a water pump 20*a* according to a second embodiment. The water pump 20*a* has a modified disk 40 fixed to the thrust shaft 29. The other construction than the disk 40 remains the same as that of the water pump 20 shown in FIG. 2. The disk 40 has recesses 40*a* through which the vanes 22*c* extend, and a shroud 40*b* extending fully circumferentially thereof in radially surrounding relation to a radially outward edge of the flange 22*b*, the shroud 40*b* extending parallel to the axis of the rotatable shaft 21.

When the temperature of engine cooling water is relatively high, the thrust shaft 29 and hence the disk 40 are moved axially to the left (FIG. 3), thus widening the range A of operation of the pump impeller 22 to increase the quantity of the cooling water flowing through the water pump 20*a*.

When the temperature of engine cooling water is relatively low, the thrust shaft 29 and the disk 40 are moved rightward to the two-dot-and-dash-line position. The range A of operation of the pump impeller 22 is reduced, and the quantity of the flowing cooling water is also reduced. The shroud 40*b* extending fully circumferentially of the disk 40 confines a region B as a space between the flange 22*b* and the disk 40, the region B being ineffective in displacing the cooling water. The power loss which would be caused by such an ineffective region can thus be reduced.

Although certain preferred embodiments have been shown and described, it should be understood that many changes and modifications may be made therein without departing from the scope of the appended claims.

What is claimed is:

1. A variable-capacity water pump comprising:

(a) a pump body containing a passage for cooling water;

(b) a rotatable shaft projecting into said passage;

(c) a pump impeller having a flange extending radially outwardly from said rotatable shaft and a plurality of impeller vanes projecting from a first side of said flange in a first direction, said impeller vanes being shaped and positioned to cause the flow of cooling water through said passage;

(d) means mounted on said rotatable shaft and disposed in said passage for detecting the temperature of the water in said passage;

(e) a thrust shaft disposed coaxially within said rotatable shaft and axially movable relative to said pump impeller by said means; and (f) a disk secured to said thrust shaft and extending radially therefrom in parallel spaced relationship to the first side of said flange, said disk being axially movable with said thrust shaft so that the axial distance between said disk and said pump impeller can be varied over a predetermined range, said disk and said pump impeller being axially positioned relative to each other and said disk having recesses therethrough sized, shaped, and positioned so that said impeller vanes project therethrough throughout the predetermined range of the axial distance between said disk and said pump impeller, said means causing said disk to move towards said pump impeller when said means detects a relatively high temperature of the water in said passage, thereby increasing the flow of cooling water caused by rotation of said pump impeller, and causing said disk to move away from said pump impeller when said means detects relatively low temperature of the water in said passage, thereby decreasing the flow of cooling water caused by rotation of said pump impeller, said disk including a circumferential shroud extending fully circumferentially of said disk in a second direction, opposite to said first direction, said circumferential shroud being in radially surrounding relationship to the radially outward edge of said flange throughout the predetermined range of the axial distance between said disk and said pump impeller, whereby said impeller, said disk, and said flange confine a region of variable volume which is ineffective in displacing the water in said passage.

2. A variable-capacity water pump as recited in claim 1 wherein said means comprise a thermostat of the wax type.

3. A variable-capacity water pump for cooling an automotive engine, said water pump comprising:

(a) a pump body containing a passage for water used to cool the cylinder block and head of the automotive engine;

(b) a rotatable shaft which, during use of the water pump, is driven by the engine, said rotatable shaft having a forward end projecting into said passage;

(c) a pump impeller comprising a boss fixedly secured to said rotatable shaft, a flange extending radially outwardly from said boss, and a plurality of impeller vanes projecting from a first side of said flange in a direction, said impeller vanes being shaped and positioned to cause the flow of cooling water through said passage;

(d) means mounted on said rotatable shaft and disposed in said passage for detecting the temperature of the water in said passage;

(e) a thrust shaft disposed coaxially within said rotatable shaft and axially movable relative to said pump impeller by said means; and (f) a disk secured to said thrust shaft and projecting radially from said thrust shaft in parallel spaced relationship to the first side of said flange, said disk being axially movable with said thrust shaft so that that axial distance between said disk and said pump impeller can be varied over a predetermined range, said disk and said pump impeller being axially positioned relative to each other and said disk having recesses therethrough sized, shaped, and positioned so that said impeller vanes project therethrough throughout the predetermined range of the axial distance between said disk and said pump impeller, said means causing said disk to move towards said pump impeller when said means detects a relatively high temperature of the water in said passage, thereby increasing the flow cooling water caused by rotation of said pump impeller, and causing said disk to move away from said pump impeller when said means detects a relatively low temperature of the wåter in said passage, thereby decreasing the flow of cooling water caused by rotation of said pump impeller, said disk including a circumferential shroud extending fully circumferentially of said disk in a second direction, opposite to said first direction, said circumferential shroud being in radially surrounding relationship to the radially outward edge of said flange throughout the predetermined range of the axial distance between said disk and said pump impeller, whereby said impeller, said disk, and said flange confine a region of variable volume which is ineffective in displacing the water in said passage.

4. A variable-capacity water pump as recited in claim 3 wherein said means comprise a thermostat of the wax, type.

* * * * *